US012799572B2

(12) United States Patent
Tanaka et al.

(10) Patent No.: US 12,799,572 B2
(45) **Date of Patent: *Nov. 17, 2026**

(54) HIGH STRENGTH STEEL SHEET, HIGH STRENGTH COATED OR PLATED STEEL SHEET, METHODS OF PRODUCING THESE, AND MEMBER

(71) Applicant: JFE STEEL CORPORATION, Tokyo (JP)

(72) Inventors: Yuji Tanaka, Tokyo (JP); Kazuki Endoh, Tokyo (JP); Hidekazu Minami, Tokyo (JP); Junya Tobata, Tokyo (JP); Yuki Toji, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 427 days.

This patent is subject to a terminal disclaimer.

(21) Appl. No.: 18/682,114

(22) PCT Filed: Jun. 21, 2022

(86) PCT No.: PCT/JP2022/024764

§ 371 (c)(1),
(2) Date: Feb. 8, 2024

(87) PCT Pub. No.: WO2023/032424

PCT Pub. Date: Mar. 9, 2023

(65) Prior Publication Data

US 2024/0376577 A1 Nov. 14, 2024

(30) Foreign Application Priority Data

Aug. 30, 2021 (JP) ..... 2021-140362

(51) Int. Cl.
*C21D 8/0247* (2026.01)
*C21D 6/00* (2006.01)
(Continued)

(52) U.S. Cl.
CPC ..... *C22C 38/04* (2013.01); *C21D 6/005* (2013.01); *C21D 8/02* (2013.01); *C21D 8/0226* (2013.01);
(Continued)

(58) Field of Classification Search
CPC ..... C22C 38/04; C22C 38/12; C22C 38/26; C22C 38/32; C22C 38/38; C22C 38/48;
(Continued)

(56) References Cited

U.S. PATENT DOCUMENTS 10,023,947 B2 7/2018 Azuma et al.
11,225,701 B2 1/2022 Haga et al.
(Continued)

FOREIGN PATENT DOCUMENTS

CN 105814227 A 7/2016
CN 106164313 A 11/2016
(Continued)

OTHER PUBLICATIONS

Sep. 13, 2022, International Search Report issued in the International Patent Application No. PCT/JP2022/024764.
(Continued)

*Primary Examiner* — Vanessa T. Luk
(74) *Attorney, Agent, or Firm* — KENJA IP LAW PC

(57) ABSTRACT

The steel sheet comprising a chemical composition containing C, Si, Mn, P, S, Al, N, Ti, Nb, and B, with the balance being Fe and inevitable impurities, and satisfying predetermined formula (1), in which the total area ratio of martensite and bainite is 95% or more, the grain size of prior austenite grains is 10 μm or less, the B concentration at a prior austenite grain boundary is 0.10% or more in mass %, the C concentration at the prior austenite grain boundary is 1.5 times or more than the C content in the steel, the amount of precipitated Fe is 200 mass ppm or less, and for a defined in
(Continued)

predetermined formula (2), a ratio of $a_{dislocation}$ on dislocation to $a_{grain\ boundary}$ on the prior austenite grain boundary: $a_{dislocation}/a_{grain\ boundary}$ is 1.3 or more.

12 Claims, 2 Drawing Sheets

(51) Int. Cl.

| | |
|---|---|
| ***C21D 8/02*** | (2006.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C23C 2/06*** | (2006.01) |

(52) U.S. Cl.
CPC ..... *C21D 8/0236* (2013.01); *C21D 8/0273* (2013.01); *C21D 9/46* (2013.01); *C22C 38/001* (2013.01); *C22C 38/002* (2013.01); *C22C 38/02* (2013.01); *C22C 38/06* (2013.01); *C22C 38/12* (2013.01); *C22C 38/14* (2013.01); *C23C 2/06* (2013.01); *C21D 2211/001* (2013.01); *C21D 2211/002* (2013.01); *C21D 2211/008* (2013.01)

(58) Field of Classification Search
CPC ... C22C 38/54; C22C 38/58; C21D 2211/002; C21D 2211/008; C21D 1/26; C21D 8/0273; C21D 8/0473; C21D 9/46
See application file for complete search history.

(56) References Cited

U.S. PATENT DOCUMENTS

| | | | | |
|---|---|---|---|---|
| 2016/0319385 | A1 | 11/2016 | Hasegawa et al. | |
| 2017/0107591 | A1 | 4/2017 | Takashima et al. | |
| 2019/0194775 | A1 | 6/2019 | Ono et al. | |
| 2019/0203315 | A1 | 7/2019 | Obata et al. | |
| 2020/0040420 | A1 | 2/2020 | Minami et al. | |
| 2021/0017622 | A1* | 1/2021 | Haga | B32B 15/013 |
| 2022/0090223 | A1 | 3/2022 | Hasegawa et al. | |
| 2022/0119908 | A1 | 4/2022 | Yokoyama et al. | |
| 2022/0340989 | A1 | 10/2022 | Tanaka et al. | |

FOREIGN PATENT DOCUMENTS

| | | | |
|---|---|---|---|
| CN | 109642281 | A | 4/2019 |
| CN | 110312813 | A | 10/2019 |
| CN | 113227430 | A | 8/2021 |
| JP | 4949536 | B2 | 6/2012 |
| JP | 2013104081 | A | 5/2013 |
| JP | 2017145441 | A | 8/2017 |
| JP | 6421903 | B1 | 11/2018 |
| WO | 2018062380 | A1 | 4/2018 |
| WO | 2020162561 | A1 | 8/2020 |
| WO | 2021033407 | A1 | 2/2021 |

OTHER PUBLICATIONS

H.S. Kitaguchi et al., Quantitative analysis of carbon in cementite using pulsed laser atom probe, Ultramicroscopy, 2014, pp. 51-60, vol. 147.

J. Takahashi et al., Quantitative analysis of carbon content in cementite in steel by atom probe tomography, Ultramicroscopy, 2011, pp. 1233-1238, vol. 111.

Nov. 25, 2024, the Extended European Search Report issued by the European Patent Office in the corresponding European Patent Application No. 22864012.4.

Apr. 25, 2026, Office Action issued by the China National Intellectual Property Administration in the corresponding Chinese Patent Application No. 202280056644.5 with English language search report.

* cited by examiner

HIGH STRENGTH STEEL SHEET, HIGH STRENGTH COATED OR PLATED STEEL SHEET, METHODS OF PRODUCING THESE, AND MEMBER

TECHNICAL FIELD

The present disclosure relates to a high strength steel sheet and a method of producing the same.

BACKGROUND

Automotive steel sheets are required to have higher strength to improve fuel efficiency by reducing the weight of the automotive body. High strength steel sheets with a tensile strength of 1180 MPa or higher are required for frame parts. In addition, high bendability is required for steel sheets to be subjected to press working and formed into desired shapes. Furthermore, from the viewpoint of crashworthiness of automobiles, there are some automotive parts required not to easily deform to ensure driver's and passenger's living space during a collision, in addition to strength. The use of steel sheets with a high yield ratio is desirable for such automotive parts. In addition, high toughness is required to ensure that automotive parts do not fracture in a collision.

JP2017145441A (PTL 1) discloses a high strength steel sheet with high reliability against hydrogen embrittlement resistance and a method of producing the same. JP6421903B (PTL 2) discloses a high strength hot-dip galvanized steel sheet and a high strength galvannealed steel sheet with excellent ductility and low-temperature impact properties and a method of producing the same. JP4949536B (PTL 3) discloses a high strength steel sheet with a maximum tensile strength of 900 MPa or higher having excellent hydrogen embrittlement resistance and a method of producing the same.

CITATION LIST

Patent Literature

PTL 1: JP2017145441A
PTL 2: JP6421903B
PTL 3: JP4949536B

SUMMARY

Technical Problem

However, although hydrogen embrittlement resistance is considered as a delayed fracture resistance in PTL 1, it is not possible to obtain a steel sheet with a tensile strength of 1180 MPa or higher. Toughness is also not considered. Delayed fracture resistance is not considered in PTL 2. Toughness is not considered in PTL 3.

As described above, it is difficult to produce a high strength steel sheet with a tensile strength of 1180 MPa or higher and excellent delayed fracture resistance and toughness using conventional techniques.

This disclosure has been made in view of these circumstances. It could be helpful to provide a high strength steel sheet with a tensile strength of 1180 MPa or higher and excellent delayed fracture resistance and toughness, and a method of producing the same.

In this disclosure, high strength means that a tensile strength TS measured in accordance with JIS Z2201 is 1180 MPa or higher.

Excellent delayed fracture resistance means that when the test specimen is subjected to a constant load test with a tensile stress of 1800 MPa on the surface layer, no crack occurs after 100 hours of electrolytic charging.

Excellent toughness means that the brittle-ductile transition temperature is −40° C. or lower in a Charpy impact test conducted in accordance with JIS Z2242.

Solution to Problem

We conducted diligent studies to accomplish the above-mentioned tasks and discovered the following.

(1) Delayed fracture is crack propagation along the prior austenite grain boundary of martensitic microstructure. Therefore, refining crystal grains to complicate the fracture path and increasing the strength of the grain boundary are effective in improving delayed fracture resistance. These are also effective in improving toughness at the same time. To refine prior austenite grains, it is effective to keep the annealing temperature as low as possible at a temperature equal to or higher than 850° C., which is an austenite single phase region. On the other hand, grain boundary segregation of B is effective in strengthening the grain boundary, but the grain boundary segregation amount of B increases as being annealed at higher temperature. Therefore, to increase the grain boundary segregation amount of B while maintaining fine crystal grain size, annealing is performed at around 850° C. to obtain fine austenite grains, followed by rapid heating and rapid cooling. This promotes grain boundary segregation of B by diffusion while inhibiting crystal grain growth, thereby simultaneously achieving austenite grain size refinement and grain boundary segregation of B.

(2) Delayed fracture is promoted by hydrogen entering the steel sheet and accumulating at dislocations. Simply refining the prior austenite grains and segregating B at the grain boundary is not sufficient to obtain sufficient delayed fracture resistance because the martensitic microstructure contains a large amount of dislocation. However, when the steel sheet is tempered to form carbon clusters on the dislocation, the interaction between the carbon clusters and hydrogen causes hydrogen to be trapped more strongly in the clusters than in the dislocation, rendering the hydrogen harmless. In addition, the diffusion of carbon during tempering causes carbon to segregate at the prior austenite grain boundary and strengthen the grain boundary, which can further improve delayed fracture resistance and toughness. In the early stages of tempering, carbon segregation or locking to the dislocation occurs before the carbon clusters are formed. However, segregated or locked carbon has a low hydrogen trapping capacity and is less effective in improving delayed fracture resistance. As tempering progresses, the carbon is transitioned from segregation and locking onto the dislocation to carbon clusters. When analyzed by a 3 dimensional atom probe (3DAP), carbon segregated and locked onto the dislocation or segregated at the grain boundary is detected as monomer ions (mass-to-charge ratio of 6 or 12), while carbon transitioned to clusters is often detected in the form of multiple carbon ions bonded together with a mass-to-charge ratio of 24. Therefore, the 3DAP can be used to determine whether the carbon present on the dislocation is in a cluster form, which is effective in improving delayed fracture resistance, or in a segregated or locked state, which is less effective in improving delay fracture resistance.

This disclosure is based on the aforementioned discoveries and primary features thereof are described below.

[1] A high strength steel sheet comprising a chemical composition containing (consisting of), in mass %:

C: 0.10% or more and 0.30% or less;

Si: 0.20% or more and 1.20% or less;

Mn: 2.5% or more and 4.0% or less;

P: 0.050% or less;

S: 0.020% or less;

Al: 0.10% or less;

N: 0.01% or less;

Ti: 0.100% or less;

Nb: 0.002% or more and 0.050% or less; and

B: 0.0005% or more and 0.0050% or less, with the balance being Fe and inevitable impurities, and satisfying the following formula (1), wherein the total area ratio of martensite and bainite is 95% or more, the grain size of prior austenite grains is 10 μm or less, the B concentration at a prior austenite grain boundary is 0.10% or more in mass %, the C concentration at the prior austenite grain boundary is 1.5 times or more than the C content in the steel, the amount of precipitated Fe is 200 mass ppm or less, and for a defined in the following formula (2), a ratio of $a_{dislocation}$ on dislocation to $a_{grain\ boundary}$ on the prior austenite grain boundary: $a_{dislocation}/a_{grain\ boundary}$ is 1.3 or more:

$$([\%\ N]/14)/([\%\ Ti]/47.9) < 1.0;\ \text{and} \quad (1)$$

$$a = C_2^+/(C^{2+} + C^+), \quad (2)$$

in the formula (1), [% N] and [% Ti] indicate the N content and the Ti content in the steel in mass %, respectively, and in the formula (2):

$C_2^+$ indicates an ion intensity with a mass-to-charge ratio of 24 Da analyzed with a 3D atom probe;

$C_2^+$ indicates an ion intensity with a mass-to-charge ratio of 6 Da analyzed with the 3D atom probe; and $C^+$ indicates an ion intensity with a mass-to-charge ratio of 12 Da analyzed with the 3D atom probe.

[2] The high strength steel sheet according to [1] above, wherein the chemical composition further contains at least one element selected from, in mass %:

V: 0.100% or less;

Mo: 0.500% or less;

Cr: 1.00% or less;

Cu: 1.00% or less;

Ni: 0.50% or less;

Sb: 0.200% or less;

Sn: 0.200% or less;

Ta: 0.200% or less;

W: 0.400% or less;

Zr: 0.0200% or less;

Ca: 0.0200% or less;

Mg: 0.0200% or less;

Co: 0.020% or less;

REM: 0.0200% or less;

Te: 0.020% or less;

Hf: 0.10% or less; or

Bi: 0.200% or less.

[3] A high strength coated or plated steel sheet having a coated or plated layer on at least one surface of the high strength steel sheet according to [1] or [2] above.

[4] A method of producing a high strength steel sheet, comprising:

hot rolling a steel slab having the chemical composition according to [1] or [2] above to form a hot-rolled sheet;

cold rolling the hot-rolled sheet to form a cold-rolled sheet;

performing an annealing process in which the cold-rolled sheet is heated to a first heating temperature of 850° C. or higher and 920° C. or lower and held for 10 seconds or longer, the temperature is then raised to a second heating temperature of 1000° C. or higher and 1200° C. or lower at an average heating rate of 50° C./s or more, and the sheet is cooled to 500° C. or lower at an average cooling rate of 50° C./s or more within 5 seconds after reaching the second heating temperature, and after the annealing process, performing a reheating process in which the cold-rolled sheet is held at a reheating temperature of 70° C. or higher and 200° C. or lower for 600 seconds or longer to obtain a high strength steel sheet.

[5] A method of producing a high strength coated or plated steel sheet, comprising a coating or plating process in which, after the annealing process according to [4] above and before the reheating process, the high strength steel sheet is subjected to coating or plating treatment to obtain a high strength coated or plated steel sheet.

[6] A member formed using the high strength steel sheet according to [1] or [2] above for at least a portion thereof.

[7] A member formed using the high strength coated or plated steel sheet according to [3] above for at least a portion thereof.

Advantageous Effect

According to this disclosure, it is possible to provide a high strength steel sheet with a tensile strength of 1180 MPa or higher and excellent delayed fracture resistance and toughness, and a method of producing the same.

DETAILED DESCRIPTION

Figure 1A:
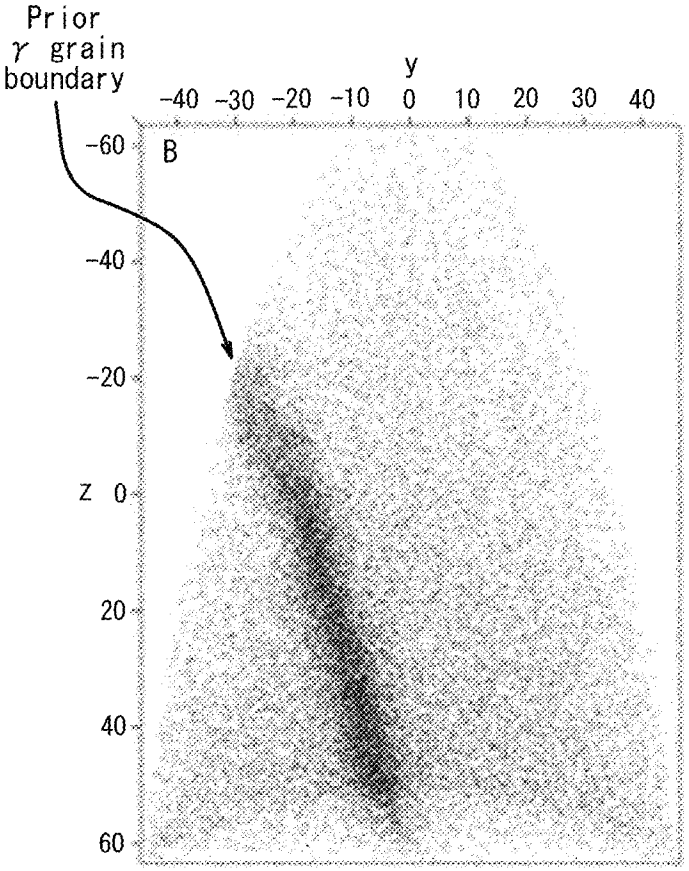
FIG. 1A and FIG. 1B are drawings to illustrate an example of 3D atomic maps obtained by a 3D atom probe.

The following describes embodiments of the present disclosure. However, this disclosure is not limited to the following embodiments. First, description will be made on the appropriate range of the chemical composition of steel sheets and the reasons for its limitation. The "%" representations below indicating the chemical composition of the steel sheet are in "mass %" unless stated otherwise. Unless stated otherwise, "ppm" means "mass ppm". In the present specification, a numerical range expressed by using "to" means a range including numerical values described before and after "to", as the lower limit value and the upper limit value.

C: 0.10% or More and 0.30% or Less

In addition to strengthening the martensitic and bainitic microstructures, C has the effect of strengthening the grain boundary by segregating at dislocations accumulated near the prior austenite grain boundary, thereby increasing delayed fracture resistance. C also has the effect of forming clusters on the dislocation and serving as a strong trapping site for hydrogen, thereby improving delayed fracture resistance. When the C content is less than 0.10%, the area ratios of martensite and bainite decrease, and a TS of 1180 MPa or higher cannot be obtained. When the C content exceeds 0.30%, carbon borides with B and iron are formed during annealing, and a sufficient amount of B cannot be segregated on the grain boundary. The C content is preferably 0.11% or more. The C content is preferably 0.28% or less.

Si: 0.20% or More and 1.20% or Less

Si is an element effective for solid solution strengthening and requires an addition of 0.20% or more. On the other hand, Si has the effect of inhibiting the formation of carbides and carbon clusters. When the Si content exceeds 1.20%, carbon clusters are not formed on the dislocation. The Si content is preferably 0.50% or more. The Si content is preferably 1.10% or less.

Mn: 2.5% or More and 4.0% or Less

Mn is effective in improving hardenability. When the Mn content is less than 2.5%, the area ratios of martensite and bainite decrease, resulting in lower strength. On the other hand, when the Mn content exceeds 4.0%, the segregated portions are excessively hardened, resulting in lower bendability. The Mn content is preferably 2.8% or more. The Mn content is preferably 3.5% or less.

P: 0.050% or Less

The P content is 0.050% or less because P segregates at the prior austenite grain boundary and reduces toughness and delayed fracture resistance. No particular lower limit is placed on the P content, which may be 0%. However, the P content is preferably 0.001% or more because a P content of less than 0.001% increases the production cost. The P content is preferably 0.025% or less.

S: 0.020% or Less

The S content is 0.020% or less because S segregates at the prior austenite grain boundary and reduces toughness and delayed fracture resistance. No particular lower limit is placed on the S content. However, the S content is preferably 0.0001% or more because a S content of less than 0.0001% increases the production cost. The S content is preferably 0.018% or less.

Al: 0.10% or Less

Al is an element that acts as a deoxidizing material. To obtain such an effect, the Al content is preferably 0.005% or more. On the other hand, when the Al content exceeds 0.10%, ferrite is easily generated, and strength is reduced. The Al content is preferably 0.05% or less.

N: 0.01% or Less

N forms nitrides with Nb or B, reducing the effect of Nb and B addition. Therefore, the N content is 0.01% or less. The N content is preferably 0.006% or less. No particular lower limit is placed on the N content. However, from the viewpoint of production cost, the N content is preferably 0.0001% or more.

Ti: 0.100% or Less

Ti has the effect of fixing Nin steel as TiN and inhibiting the generation of BN and NbN, thereby improving the effect of Nb and B addition and improving delayed fracture resistance. To achieve these effects, the Ti content is preferably 0.005% or more. On the other hand, when the Ti content exceeds 0.100%, coarse Ti carbides are formed on the grain boundary, and toughness is reduced. The Ti content is preferably 0.05% or less.

Nb: 0.002% or more and 0.050% or Less

Nb precipitates as a solute or fine carbides and inhibits the growth of austenite grains during annealing. Nb can refine the crystal grain size to complicate the fracture path, thereby improving toughness and delayed fracture resistance. To achieve such an effect, the Nb content is 0.002% or more. On the other hand, when the Nb content exceeds 0.050%, not only does the effect saturate, but coarse Nb carbides precipitate and the toughness is reduced. The Nb content is preferably 0.005% or more. The Nb content is preferably 0.040% or less.

B: 0.0005% or more and 0.0050% or Less

B segregates at the prior austenite grain boundary and has the effect of increasing grain boundary strength and improving delayed fracture resistance. To achieve such an effect, the B content is 0.0005% or more. On the other hand, when the B content exceeds 0.0050%, carbon borides are formed, and toughness is reduced. The B content is preferably 0.0010% or more. The B content is preferably 0.0030% or less.

$$([\%\ N]/14)/([\%\ Ti]/47.9) < 1.0 \quad (1)$$

To achieve the above-described effect of B and Nb addition, N, which readily combines with these elements, needs to be fixed by Ti. Therefore, the mole fraction of N is set to be smaller than the mole fraction of Ti. In other words, the N content and the Ti content in the steel are adjusted to satisfy the above formula (1). In the formula (1), [% N] and [% Ti] indicate the N content and the Ti content in the steel (mass %), respectively.

[Optional Component]

The high strength cold-rolled steel sheet according to the embodiment may further contain at least one element selected from, in mass %: V: 0.100% or less; Mo: 0.500% or less; Cr: 1.00% or less; Cu: 1.00% or less; Ni: 0.50% or less; Sb: 0.200% or less; Sn: 0.200% or less; Ta: 0.200% or less; W: 0.400% or less; Zr: 0.0200% or less; Ca: 0.0200% or less; Mg: 0.0200% or less; Co: 0.020% or less; REM: 0.0200% or less; Te: 0.020% or less; Hf: 0.10% or less; or Bi: 0.200% or less, in addition to the above-described chemical composition.

V: 0.100% or Less

V has the effect of forming fine carbides and increasing strength. When the V content exceeds 0.100%, coarse V carbides precipitate, and toughness is reduced. No particular lower limit is placed on the V content, which may be 0.000%. However, the V content is preferably 0.001% or more because V has the effect of forming fine carbides and increasing strength.

Mo: 0.500% or Less

Mo has the effect of improving hardenability and increasing the area ratios of bainite and martensite. When the Mo content exceeds 0.500%, the effect is saturated. No particular lower limit is placed on the Mo content, which may be 0.000%. However, the Mo content is preferably 0.010% or more because Mo has the effect of improving hardenability and increasing the area ratios of bainite and martensite.

Cr: 1.00% or Less

Cr has the effect of improving hardenability and increasing the area ratios of bainite and martensite. When the Cr content exceeds 1.00%, the effect is saturated. No particular lower limit is placed on the Cr content, which may be 0.000%. However, the Cr content is preferably 0.01% or more because Cr has the effect of improving hardenability and increasing the area ratios of bainite and martensite.

Cu: 1.00% or Less

Cu has the effect of increasing strength by the formation of a solute. Cu also has the effect of improving delayed fracture resistance. When the Cu content exceeds 1.00%, intergranular cracking tends to be generated. No particular lower limit is placed on the Cu content, which may be 0.000%. However, the Cu content is preferably 0.01% or more because Cu has the effect of increasing strength by the formation of a solute.

Ni: 0.50% or Less

Ni has the effect of improving hardenability. However, when the Ni content exceeds 0.50%, the effect is saturated. No particular lower limit is placed on the Ni content, which may be 0.000%. However, the Ni content is preferably 0.01% or more because Ni has the effect of improving hardenability.

Sb: 0.200% or Less

Sb has the effect of suppressing surface oxidation, nitriding, and decarburization of steel sheets. However, when the Sb content exceeds 0.200%, the effect is saturated. No particular lower limit is placed on the Sb content, which may be 0.000%. However, the Sb content is preferably 0.001% or more because Sb has the effect of suppressing surface oxidation, nitriding, and decarburization of steel sheets.

Sn: 0.200% or Less

Sn, like Sb, has the effect of suppressing surface oxidation, nitriding, and decarburization of steel sheets. When the Sn content exceeds 0.200%, the effect is saturated. No particular lower limit is placed on the Sn content, which may be 0.000%. However, the Sn content is preferably 0.001% or more because Sn has the effect of suppressing surface oxidation, nitriding, and decarburization of steel sheets.

Ta: 0.200% or Less

Ta has the effect of forming fine carbides and increasing strength. When the Ta content exceeds 0.200%, coarse Ta carbides precipitate, and toughness is reduced. No particular lower limit is placed on the Ta content, which may be 0.000%. However, the Ta content is preferably 0.001% or more because Ta has the effect of forming fine carbides and increasing strength.

W: 0.400% or Less

W has the effect of forming fine carbides and increasing strength. When the W content exceeds 0.400%, coarse W carbides precipitate, and toughness is reduced. No particular lower limit is placed on the W content, which may be 0.000%. However, the W content is preferably 0.001% or more because W has the effect of forming fine carbides and increasing strength.

Zr: 0.0200% or Less

Zr has the effect of spheronizing the shape of inclusions, suppressing stress concentration, and improving toughness. When the Zr content exceeds 0.0200%, a large amount of inclusions are formed, and toughness is reduced. No particular lower limit is placed on the Zr content, which may be 0.000%. However, the Zr content is preferably 0.0001% or more because Zr has the effect of spheronizing the shape of inclusions, suppressing stress concentration, and improving toughness.

Ca: 0.0200% or Less

Ca can be used as a deoxidizing material. When the Ca content exceeds 0.0200%, a large amount of Ca-based inclusions are formed, and toughness is reduced. No particular lower limit is placed on the Ca content, which may be 0.000%. However, the Ca content is preferably 0.0001% or more because Ca can be used as a deoxidizing material.

Mg: 0.0200% or Less

Mg can be used as a deoxidizing material. When the Mg content exceeds 0.0200%, a large amount of Mg-based inclusions are formed, and toughness is reduced. No particular lower limit is placed on the Mg content, which may be 0.000%. However, the Mg content is preferably 0.0001% or more because Mg can be used as a deoxidizing material.

Co: 0.020% or Less

Co has the effect of increasing strength by solid solution strengthening. When the Co content exceeds 0.020%, the effect is saturated. No particular lower limit is placed on the Co content, which may be 0.000%. However, the Co content is preferably 0.001% or more because Co has the effect of increasing strength by solid solution strengthening.

REM: 0.0200% or Less

REM has the effect of spheronizing the shape of inclusions, suppressing stress concentration, and improving toughness. When the REM content exceeds 0.0200%, a large amount of inclusions are formed, and toughness is reduced. No particular lower limit is placed on the REM content, which may be 0.000%. However, the REM content is preferably 0.0001% or more because REM has the effect of spheronizing the shape of inclusions, suppressing stress concentration, and improving toughness.

Te: 0.020% or Less

Te has the effect of spheronizing the shape of inclusions, suppressing stress concentration, and improving toughness. When the Te content exceeds 0.020%, a large amount of inclusions are formed, and toughness is reduced. No particular lower limit is placed on the Te content, which may be 0.000%. However, the Te content is preferably 0.001% or more because Te has the effect of spheronizing the shape of inclusions, suppressing stress concentration, and improving toughness.

Hf: 0.10% or Less

Hf has the effect of spheronizing the shape of inclusions, suppressing stress concentration, and improving toughness. When the Hf content exceeds 0.10%, a large amount of inclusions are formed, and toughness is reduced. No particular lower limit is placed on the Hf content, which may be 0.000%. However, the Hf content is preferably 0.01% or more because Hf has the effect of spheronizing the shape of inclusions, suppressing stress concentration, and improving toughness.

Bi: 0.200% or Less

Bi has the effect of reducing segregation and improving bendability. When the Bi content exceeds 0.200%, a large amount of inclusions are formed, and bendability is reduced. No particular lower limit is placed on the Bi content, which may be 0.000%. However, the Bi content is preferably 0.001% or more because Bi has the effect of reducing segregation and improving bendability.

The balance other than the above-described components is Fe and inevitable impurities. The effect of this disclosure is not impaired when each of the contents of the above optional components is less than the lower limit. Thus, these optional components are treated as inevitable impurities when they are contained with a content that is less than the lower limit.

[Steel Microstructure]

Next, a steel microstructure of the steel sheet will be described.

Martensite and Bainite: Total Area Ratio of 95% or More

Both martensite and bainite are hard phases and are necessary to achieve a TS of 1180 MPa or higher. Therefore, the total area ratio of martensite and bainite is 95% or more. The total area ratio of martensite and bainite is preferably 96% or more. No particular upper limit is placed on the total area ratio of martensite and bainite, which may be 100%.

The steel microstructure may contain residual microstructures other than martensite and bainite. The residual microstructures include ferrite, residual austenite, and cementite. The residual microstructures are 5% or less of the total area ratio.

The area ratio of each microstructure is measured as follows. The area ratio of residual austenite is obtained by chemically polishing the rolled surface of a test specimen taken from each steel sheet up to ¼t of the sheet thickness, measuring the X-ray diffraction intensity and diffraction peak positions of the polished surface using an X-ray diffraction (XRD) instrument, calculating the volume fraction, and considering the volume fraction as the area ratio of residual austenite. Next, a cross section of each steel sheet taken in the sheet thickness direction parallel to the rolling direction is polished and then etched with 3% nital, and the ¼t position of the sheet thickness is used as the observation plane. SEM images in three fields of view are taken of the observation plane at a magnification of 2000×. The total area ratio of martensite, bainite, and residual austenite and the area ratio of microstructures (ferrite and cementite) other than martensite, bainite, and residual austenite are determined by image analysis of the obtained SEM images. The area ratio of martensite and bainite is determined by subtracting the area ratio of residual austenite obtained by XRD from the area ratio of martensite, bainite, and residual austenite obtained by image analysis. The average value of the three fields of view is taken as the area ratio of the microstructure.

Prior Austenite Grain Size: 10 μm or Less

Toughness and delayed fracture resistance can be improved by complicating a crack propagation path. To obtain these effects, the prior austenite grain size needs to be 10 μm or less. The prior austenite grain size is preferably 9 μm or less. No particular lower limit is placed on the average grain size of prior austenite grains. However, from the viewpoint of production technology, the average grain size of prior austenite grains is preferably 1 μm or more.

The average grain size of prior austenite grains is measured as follows. A cross section of each steel sheet taken in the sheet thickness direction parallel to the rolling direction is polished and then etched with picral to be used as the observation plane. On the observation plane, SEM images are taken of the microstructure at the ¼*t* position of the sheet thickness with a magnification of 2000× in three fields of view by SEM. The grain size of each prior austenite grain is determined from the obtained microstructure image by image analysis, and the average value of the three fields of view is considered as the average grain size of prior austenite grains.

B Concentration at Prior Austenite Grain Boundary: 0.10% or More in Mass %

B can strengthen the grain boundary by segregating at the prior austenite grain boundary and improve toughness and delayed fracture resistance. This effect can be achieved when the B concentration at the prior austenite grain boundary is 0.10% or more in mass %. The B concentration at the prior austenite grain boundary is preferably 0.15% or more, and more preferably 0.20% or more in mass %. No upper limit is placed on the B concentration at the prior austenite grain boundary. However, the B concentration at the prior austenite grain boundary is preferably less than 20% to suitably prevent precipitation of hard carbon borides on the grain boundary and to further improve toughness.

C Concentration at Prior Austenite Grain Boundary: 1.5 Times or More than C Content in Steel Like B, C also strengthens the grain boundary by segregating at the prior austenite grain boundary and improves toughness and delayed fracture resistance. This effect can be achieved when the C concentration at the prior austenite grain boundary is 1.5 times or more than the C content in the steel. That is, the C concentration at the prior austenite grain boundary satisfies the following formula (3):

$$\text{C concentration at prior austenite grain boundary (mass \%)/C content in steel (mass \%)} \geq 1.5. \quad (3)$$

The C concentration at the prior austenite grain boundary is preferably 2.0 times or more, and more preferably 2.5 times or more than the C content in the steel. No upper limit is placed on the C concentration at the prior austenite grain boundary. However, the C concentration is preferably less than 20% in mass % to suitably prevent precipitation of hard carbides or carbon borides on the grain boundary and to further improve toughness.

The B concentration and the C concentration at the prior austenite grain boundary are measured as follows. A needle sample is prepared from the region containing the prior austenite grain boundary by SEM-Focused Ion Beam (FIB) method. The obtained needle sample is subjected to 3DAP analysis using a 3DAP instrument (LEAP 4000X Si, made by AMETEK). The measurement is performed in laser mode. The sample temperature is 80 K or lower. The B concentration and the C concentration at the prior austenite grain boundary are determined from the number of B and C ions and the number of other ions detected from the prior austenite grain boundary.

Amount of Precipitated Fe: 200 Mass Ppm or Less

To improve delayed fracture resistance, it is effective to disperse carbon clusters on the dislocation. On the other hand, cementite has less hydrogen trapping capacity than carbon clusters. It is thus necessary to form carbon clusters to suppress cementite precipitation during tempering of steel sheets. Only cementite can be evaluated by the amount of precipitated Fe because the carbon clusters are not included in the amount of precipitated Fe. Setting the amount of precipitated Fe to 200 mass ppm or less can suppress cementite precipitation to improve delayed fracture resistance. The amount of precipitated Fe is preferably 180 mass ppm or less. No particular lower limit is placed on the amount of precipitated Fe. However, from the viewpoint of production technology, the amount of precipitated Fe is preferably 5 mass ppm or more.

The amount of precipitated Fe is measured as follows. The steel sheet is cut to make a 15 mm×15 mm test specimen. The test specimen is electrolyzed at a constant current using a 10% acetylacetone electrolyte (10 vol % acetylacetone-1 mass % tetramethylammonium chloride-methanol). The electrolyte is then collected and filtered through a filter with a filter pore diameter of 0.1 μm to collect precipitates. The collected precipitates are dissolved in mixed acid with the filter to prepare a solution. The solution is analyzed using a high-frequency inductively coupled plasma (ICP) emission spectrometric analyzer to measure the amount of precipitated Fe.

Ratio of $a_{dislocation}$ on dislocation to $a_{grain\ boundary}$ on prior austenite grain boundary defined by formula (2): $a_{dislocation}/a_{grain\ boundary}$ of 1.3 or more $$a = C_2^+/(C^{2+} + C^+) \quad (2)$$

In the formula (2):

$C_2^+$ indicates an ion intensity with a mass-to-charge ratio of 24 Da analyzed with a 3D atom probe;

$C_2^+$ indicates an ion intensity with a mass-to-charge ratio of 6 Da analyzed with the 3D atom probe; and $C^+$ indicates an ion intensity with a mass-to-charge ratio of 12 Da analyzed with the 3D atom probe.

Figure 1B:
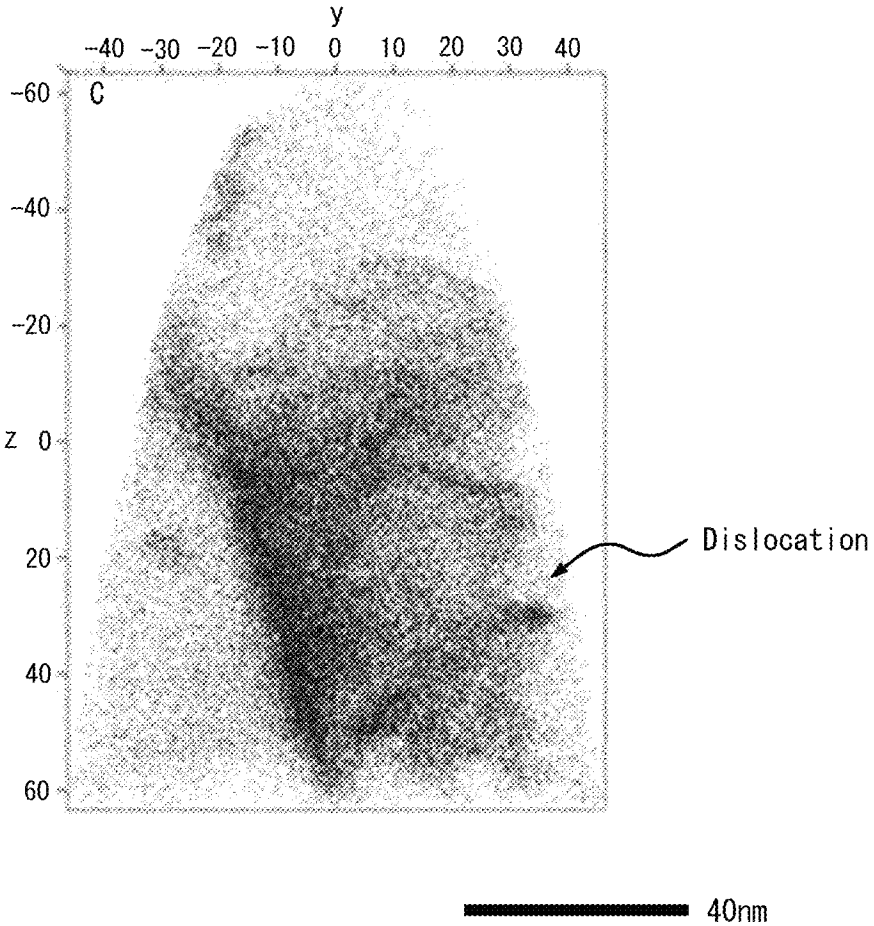
Figure 2B:
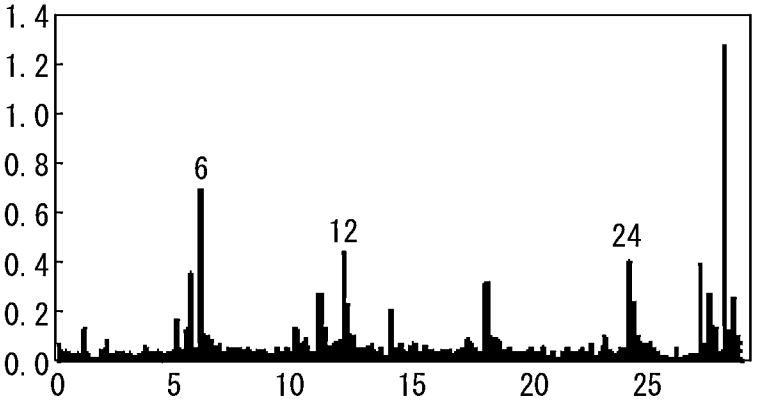
FIG. 2A and FIG. 2B are drawings illustrating an example of spectra of mass-to-charge ratios on the dislocation and at the prior austenite grain boundary obtained by the 3D atom probe.
Figure 2A:
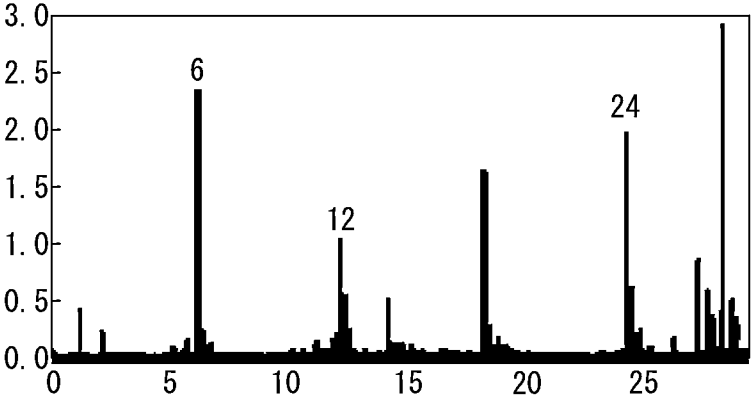

This is one of the important constituent requirements for this high strength steel sheet. As described above, tempering of the steel sheet can improve delayed fracture resistance by transitioning carbon to carbon clusters. The formation of carbon clusters can be determined by analyzing the high strength steel sheet with a 3DAP. Referring to FIG. 1A and FIG. 1B, an example of 3D atomic maps obtained by a 3D atom probe is described. FIG. 1A is a 3D atomic map for B, while FIG. 1B is a 3D atomic map for C of the same sample. As illustrated in FIG. 1A, B segregates at the prior austenite grain boundary. In FIG. 1A, the part where B segregates in a planar pattern corresponds to the prior austenite grain boundary. In contrast, as illustrated in FIG. 1B, C segregates on the dislocation as well as at the prior austenite grain boundary. In FIG. 1B, the region where C segregates in a planar pattern corresponds to the prior austenite grain boundary. On the other hand, in FIG. 1B, the region 10) where C segregates in a linear pattern corresponds to the dislocation. FIG. 2A and FIG. 2B illustrate an example of spectra of mass-to-charge ratios determined for on the prior austenite grain boundary and on the dislocation. FIG. 2A illustrates an example of the spectrum of a mass-to-charge ratio determined for on the dislocation. FIG. 2B illustrates an example of the spectrum of a mass-to-charge ratio determined for on the prior austenite grain boundary. For the spectra of the mass-to-charge ratios on the dislocation and on the prior austenite grain boundary, the ion intensities with mass-to-charge ratios of 6 Da, 12 Da, and 24 Da are each illustrated in FIG. 2A and FIG. 2B. From the comparison of FIG. 2A and FIG. 2B, it can be seen that the percentage of ionic intensity with a mass-to-charge ratio of 24 Da is higher at the location corresponding to the dislocation than at the location corresponding to the prior austenite grain boundary. In the mass-to-charge ratio spectrum of 3DAP, the peak with a mass-to-charge ratio of 24 Da is the peak corresponding to two or more carbon ions bonded together, specifically the peak corresponding to $C_2$ or $C_4^{2+}$. Since it is difficult to completely distinguish $C_2$ and $C_4^{2+}$, $C_2$ and $C_4^{2+}$ are collectively referred to as $C_2$ herein for convenience. The peak with a mass-to-charge ratio of 24 Da is attributed to precipitates in which carbon is locally concentrated or carbon clusters. In contrast, the peak with a mass-to-charge ratio of 6 Da and the peak with a mass-to-charge ratio of 12 Da are the peak corresponding to $C_2$ and the peak corresponding to $C^+$, respectively. These peaks indicate carbon in a solid solution state, carbon segregated at the prior austenite grain boundary, or carbon segregated or locked onto the dislocation. Here, the carbon that is considered to be on the dislocation as a result of thermodynamic interaction with the dislocation is referred to as a carbon in the "segregated" state, while the carbon that is considered to be on the dislocation as a result of elastic interaction with the dislocation is referred to as a carbon in the "locked" state. Therefore, by examining their ratio a defined by the above formula (2), it is possible to identify whether the carbon in the region of interest is in a precipitated or clustered state or in a solid solution or segregated state. However, the height of these peaks in the mass-to-charge ratio spectrum also depends on the analytical conditions of the 3DAP. Therefore, we decided to use the reference region on the prior austenite grain boundary to examine the ratio of $a_{dislocation}$ on the dislocation to $a_{grain\ boundary}$ On the prior austenite grain boundary. This makes it possible to identify the state of C independently of the analytical conditions. That is, when $a_{dislocation}/a_{grain\ boundary}$ is less than 1.3 with $a_{grain\ boundary}$ as the reference region, the carbon on the dislocation is in the solid solution state, i.e., no carbon clusters are formed. When $a_{dislocation}/a_{grain\ boundary}$ is 1.3 or more, the carbon on the dislocation forms clusters or precipitates. Therefore, when the amount of precipitated Fe is 200 ppm or less and $a_{dislocation}/a_{grain\ boundary}$ is 1.3 or more, no cementite is precipitated and carbon clusters are dispersed on the dislocation, resulting in a state with excellent delayed fracture resistance. $a_{dislocation}/a_{grain\ boundary}$ is preferably 1.4 or more and more preferably 1.5 or more. No particular upper limit is placed on $a_{dislocation}/a_{grain\ boundary}$. However, $a_{dislocation}/a_{grain\ boundary}$ is preferably 4.0 or less because a large amount of $C_2$ causes a transition from clusters to precipitates and the amount of precipitated Fe exceeds 200 ppm.

The ratio of $a_{dislocation}$ on the dislocation to $a_{grain\ boundary}$ on the prior austenite grain boundary: $a_{dislocation}/a_{grain\ boundary}$ is measured as follows. A sharp needle sample is prepared from the region containing the prior austenite grain boundary by the SEM-FIB method. 3DAP analysis is performed using a 3DAP instrument (LEAP 4000X Si, made by AMETEK). The measurement is performed in laser mode. The sample temperature is 80 K or lower. On the obtained 3D atomic map, the carbon-concentrated region in a planar pattern is determined to correspond to the prior austenite grain boundary, and the carbon-concentrated region in a linear pattern is determined to correspond to the dislocation. The B concentration and the C concentration at the prior austenite grain boundary are determined from the number of B and C ions and the number of other ions detected from the prior austenite grain boundary. The respective mass-to-charge ratio spectra are determined for the carbon-concentrated region in a planar pattern (corresponding to the prior austenite grain boundary) and the carbon-concentrated region in a linear pattern (corresponding to the dislocation), and $a_{dislocation}$ and $a_{grain\ boundary}$ are calculated for each region.

According to this disclosure, it is possible to provide a high strength steel sheet with a tensile strength of 1180 MPa or higher. The tensile strength of the high strength steel sheet is preferably 1250 MPa or higher.

The above-described high strength steel sheet may have a coated or plated layer on at least one surface. One of a hot-dip galvanized layer, a galvannealed layer, and an electrogalvanized layer is preferred as the coated or plated layer.

No particular limitation is placed on the composition of the coated or plated layer. Any known composition can be used.

No particular limitation is placed on the composition of the hot-dip galvanized layer. A common composition may be used. In an example, the coated or plated layer contains: Fe: 20 mass % or less; and Al: 0.001 mass % or more and 1.0 mass % or less, and further contains one or two or more selected from the group consisting of Pb, Sb, Si, Sn, Mg, Mn, Ni, Cr, Co, Ca, Cu, Li, Ti, Be, Bi, and REM by the total content thereof in the range of 0 mass % or more and 3.5 mass % or less, with the balance being Zn and inevitable impurities. When the coated or plated layer is a hot-dip galvanized layer, in an example, the Fe content in the coated or plated layer is less than 7 mass %. When the coated or plated layer is a galvannealed layer, in an example, the Fe content in the coated or plated layer is 7 mass % or more and 15 mass % or less. More preferably, the Fe content in the coated or plated layer is 8 mass % or more, and the Fe content in the coated or plated layer is 13 mass % or less.

No particular limitation is placed on the coating weight. However, the coating weight per one surface of the high strength steel sheet is preferably 20 g/m$^2$ or more, and the coating weight per one surface of the high strength steel sheet is preferably 80 g/m$^2$ or less. In an example, the coated or plated layer is 25 formed on the front and back surfaces of the high strength cold-rolled steel sheet.

Next, a method of producing a high strength steel sheet will be described.

First, a steel slab having the above-described chemical composition is produced. Steel materials are first smelted to produce molten steel having the above-described chemical composition. No particular limitation is placed on the smelting method. Any of known smelting methods, such as converter smelting and electric furnace smelting, can be applied. The resulting molten steel is solidified to produce a steel slab (slab). No particular limitation is placed on the method of producing a steel slab from molten steel. Continuous casting, ingot casting, thin slab casting, or other methods can be used. The steel slab may be cooled once and then heated again before hot rolling, or a casted steel slab may be continuously hot rolled without cooling it to room temperature. In consideration of rolling load and scale generation, the slab heating temperature is preferably 1100° C. or higher, and the slab heating temperature is preferably 1300° C. or lower. No particular limitation is placed on the slab heating method. For example, the slab can be heated in a heating furnace in accordance with a conventional method.

[Hot Rolling]

Next, the heated steel slab is hot rolled to form a hot-rolled sheet. No particular limitation is placed on the hot rolling. Hot rolling may be performed in accordance with a conventional method. No particular limitation is placed on the cooling after hot rolling. The hot-rolled sheet is cooled to a coiling temperature. The hot-rolled sheet is then coiled in a coil form. The coiling temperature is preferably 400° C. or higher. This is because coiling is easier without increasing the strength of the hot-rolled sheet when the coiling temperature is 400° C. or higher. The coiling temperature is more preferably 550° C. or higher. The coiling temperature is preferably 750° C. or lower to suitably prevent thick generation of scale and to further improve yield. Before pickling, the hot-rolled sheet may be subjected to heat treatment to be softened.

[Pickling]

Optionally, scale is removed from the hot-rolled sheet that has been coiled in a coil form. No particular limitation is placed on the method of removing scale. However, pickling is preferably performed while rewinding the hot-rolled coil to completely remove scale. No particular limitation is placed on the pickling method. Pickling may be performed in accordance with a conventional method.

[Cold Rolling]

The hot-rolled sheet, which has been optionally descaled, is cleaned as appropriate, and then cold-rolled to form a cold-rolled sheet. No particular limitation is placed on the method of cold rolling. Cold rolling may be performed in accordance with a conventional method.

[Annealing]

Next, an annealing process is performed, in which the cold-rolled sheet is heated to a first heating temperature of 850° C. or higher and 920° C. or lower and held for 10 seconds or longer, then the temperature is raised to a second heating temperature of 1000° C. or higher and 1200° C. or lower at an average heating rate of 50° C./s or more, and the sheet is cooled to 500° C. or lower at an average cooling rate of 50° C./s or more within 5 seconds after reaching the second heating temperature.

First Heating Temperature of 850° C. Or Higher and 920° C. Or Lower

The cold-rolled sheet is then heated to the first heating temperature of 850° C. or higher and 920° C. or lower and held for 10 seconds or longer. To obtain a martensite and bainite-dominated microstructure, annealing is performed at the first heating temperature in the austenite single phase region. When the first heating temperature is less than 850° C., ferrite is generated, and strength is reduced. On the other hand, when the first heating temperature exceeds 920° C., the austenite grain size exceeds 10 μm, and delayed fracture resistance and toughness are reduced because the subsequent processes cannot reduce the grain size The first heating temperature is preferably 860° C. or higher. The first heating temperature is preferably 900° C. or lower.

Holding Time at First Heating Temperature: 10 Seconds or Longer

The holding time at the first heating temperature is 10 seconds or longer. By holding the sheet at the first heating temperature for 10 seconds or longer, the growth of austenite grain size is balanced by pinning by Nb carbides or growth inhabitation by solute Nb. When the holding time is less than 10 seconds, the austenite grains are in the process of growing, the effect of pinning by Nb carbides or growth inhabitation by solute Nb does not occur during the subsequent rapid heating, and the prior austenite grain size exceeds 10 μm, resulting in reduced toughness and delayed fracture resistance. No particular upper limit is placed on the holding time at the first heating temperature. However, from the viewpoint of productivity, the holding time at the first heating temperature is preferably 60 seconds or shorter. The holding time at the first heating temperature is preferably 20 seconds or longer.

Second Heating Temperature of 1000° C. Or Higher and 1200° C. Or Lower

After holding the sheet at the first heating temperature, the sheet is annealed at high temperature while maintaining the austenite grain boundary at 10 μm or less to cause a sufficient amount of B to segregate at the grain boundary. When the second heating temperature is less than 1000° C., B diffusion is slow, and grain boundary segregation is insufficient. When the second heating temperature exceeds 1200° C., austenite grain growth is rapid, and the austenite grain size exceeds 10 μm, resulting in reduced toughness and delayed fracture resistance. The second heating temperature is preferably 1020° C. or higher. The second heating temperature is preferably 1150° C. or lower.

Average Heating Rate: 50° C./s or More

An average heating rate from the first heating temperature to the second heating temperature is 50° C./s or more. When the average heating rate from the first heating temperature to the second heating temperature is less than 50° C./s, the austenite grain size exceeds 10 μm, resulting in reduced toughness and delayed fracture resistance. No particular upper limit is placed on the average heating rate from the first heating temperature to the second heating temperature. However, the average heating rate is preferably 120° C./s or less because excessive rapid heating is difficult to control. The average heating rate from the first heating temperature to the second heating temperature is preferably 80° C./s or more.

Cooling at Average Cooling Rate of 50° C./s or More to 500° C. Or Lower within 5 Seconds after Reaching Second Heating Temperature After reaching the second heating temperature, rapid cooling is started within 5 seconds after reaching the second heating temperature without holding the sheet at the second heating temperature, and the rapid cooling is performed at an average cooling rate of 50° C./s or more to 500° C. or lower. This can produce a steel microstructure with an austenite grain size of 10 μm or less and B segregated at the grain boundary by 0.10% or more. Cooling is started immediately after the second heating temperature is reached because grain growth starts quickly after holding the sheet at the second heating temperature.

Average Cooling Rate: 50° C./s or More

In the cooling after reaching the second heating temperature, an average cooling rate from the second heating temperature to 500° C. or lower is 50° C./s or more. When the average cooling rate from the second heating temperature to 500° C. or lower is less than 50° C./s, grain growth occurs during cooling. No particular upper limit is placed on the average cooling rate from the second heating temperature to 500° C. or lower. However, the average cooling rate is preferably 120° C./s or less to facilitate control. The average cooling rate from the second heating temperature to 500° C. or lower is preferably 80° C./s or more.

Cooling Stop Temperature: 500° C. or Lower

To inhibit ferrite transformation, rapid cooling is performed to a cooling stop temperature of 500° C. or lower. The cooling stop temperature is preferably 450° C. or lower. No particular lower limit is placed on the cooling stop temperature. However, the cooling stop temperature is preferably 100° C. or higher.

After the above-described annealing process and before a reheating process, a coating or plating process may be performed, in which at least one surface of the high strength steel sheet is subjected to coating or plating treatment to obtain a high strength coated or plated steel sheet. After the coating or plating process, the high strength coated or plated steel sheet may be subjected to heat treatment to alloy the coated or plated layer of the high strength coated or plated steel sheet, resulting in a galvannealed steel sheet.

After Annealing Process, Reheating Process in which Cold-Rolled Sheet is Held at Reheating Temperature of 70° C. Or Higher and 200° C. Or Lower for 600 Seconds or Longer After the above-described annealing process or after the coating or plating process, the cold-rolled sheet is tempered at a low temperature at which cementite is not precipitated. In this process, a part of C segregates at the prior austenite grain boundary. In addition, C in the solid solution state forms carbon clusters on the dislocation. When the reheating temperature is less than 70° C., C diffusion is slow, a sufficient amount of C cannot be segregated at the prior austenite grain boundary, and a sufficient amount of carbon clusters cannot be formed on the dislocation. On the other hand, when the reheating temperature exceeds 200° C., tempering is excessive, and cementite precipitates, resulting in deterioration of delayed fracture resistance. The reheating temperature is preferably 90° C. or higher. The reheating temperature is preferably 190° C. or lower.

Holding Time at Reheating Temperature: 600 Seconds or Longer

When the holding time at the reheating temperature is less than 600 seconds, C diffusion is slow, and a sufficient amount of C cannot be segregated at the prior austenite grain boundary. In addition, a sufficient amount of carbon clusters cannot be formed on the dislocation. No particular upper limit is placed on the holding time at the reheating temperature. However, the holding time is preferably 43200 seconds (0.5 days) or shorter to prevent cementite precipitation. The holding time at the reheating temperature is preferably 800 seconds or longer.

Production conditions other than those described above can be determined in accordance with conventional methods.

[Member]

It is possible to provide a member formed using the above-described high strength steel sheet or high strength coated or plated steel sheet, for at least a portion thereof. The above-described high strength steel sheet or high strength coated or plated steel sheet can be formed into a desired shape by press working, in an example, to form an automotive part. The automotive part may contain steel sheets other than the high strength steel sheet or high strength coated or plated steel sheet according to this embodiment, as its materials. According to this embodiment, it is possible to provide a high strength steel sheet with a TS of 1180 MPa or higher, delayed fracture resistance, and toughness. Therefore, the high strength steel sheet or high strength coated or plated steel sheet according to this embodiment is suitable for automotive parts that contribute to weight reduction of the automotive body. This high strength steel sheet or high strength coated or plated steel sheet can be suitably used for automotive parts, in particular, members used as skeletal structural parts or reinforcement parts in general.

EXAMPLES

Steel having the chemical compositions presented in Table 1, with the balance being Fe and inevitable impurities, was smelted in a converter furnace to form steel slabs. The resulting slabs were reheated, hot rolled, and then coiled to obtain hot-rolled coils. The hot-rolled coils were then subjected to pickling treatment while being rewound, and then cold rolled. The thickness of the hot-rolled sheets was 3.0 mm, and the thickness of the cold-rolled sheets was 1.2 mm. Annealing was performed in a continuous hot-dip galvanizing line under the conditions presented in Table 2 to obtain cold-rolled steel sheets, hot-dip galvanized steel sheets (GI), and galvannealed steel sheets (GA). The hot-dip galvanized steel sheets were immersed in a plating bath at 460° C. to achieve a coating weight of 35 g/m$^2$ per surface. The galvannealed steel sheets were produced by adjusting the coating weight to 45 g/m$^2$ per surface, followed by alloying treatment at 520° C. for 40 seconds. The resulting steel sheets were subjected to reheat treatment under the conditions presented in Table 2.

For each resulting steel sheet, the total area ratio of martensite and bainite, the prior austenite grain size, the B concentration at the prior austenite grain boundary, the C concentration at the prior austenite grain boundary (mass %)/the C content in the steel (mass %), the amount of precipitated Fe, and $a_{dislocation}/a_{grain\ boundary}$ were evaluated according to the above-described methods. The tensile strength, delayed fracture resistance, and toughness were also evaluated according to the methods described below. The results are presented in Table 3.

[Tensile Test]

The resulting steel sheets were subjected to a tensile test in accordance with JIS Z 2241. JIS No. 5 tensile test specimens were taken having a longitudinal direction perpendicular to the rolling direction, and the tensile test was conducted to measure the tensile strength (TS) and yield stress (YS). The tensile strength was considered good when the tensile strength TS was 1180 MPa or higher.

[Charpy Test]

Charpy impact test was conducted in accordance with JIS Z 2242. From each resulting steel sheet, a test specimen with a width of 10 mm, a length of 55 mm, and a 90° V-notch with a notch depth of 2 mm at the center of the length was taken such that the direction perpendicular to the rolling direction of the steel sheet was a V-notching direction. The Charpy impact test was then conducted in a test temperature range of −120° C. to +120° C. The transition curve was determined from the obtained percent brittle fracture, and the temperature at which the percent brittle fracture reaches 50% was determined as a brittle-ductile transition temperature. The toughness was considered good when the brittle-ductile transition temperature obtained from the Charpy test was −40° C. or lower. In the table, brittle-ductile transition temperatures of −40° C. or lower were indicated as "Excellent" for toughness, and brittle-ductile transition temperatures exceeding −40° C. were indicated as "Poor" for toughness.

[Delayed Fracture Test]

The delayed fracture resistance of each steel sheet was evaluated as follows. From the resulting steel sheet, a 30 mm×110 mm test specimen was taken with the rolling direction as the longitudinal direction. A strain gauge was attached to the test specimen, and a 90-degree V-bending was performed with a curvature radius of 7 mmR (R/t=5.0). The opposing surfaces of the sheet were closed together, and the tensile stress on the surface layer of the test specimen was set to 1800 MPa to form a test specimen for delayed fracture evaluation. The test specimen for delayed fracture evaluation was immersed in an aqueous hydrochloric acid solution at pH 3, and the presence of cracks was examined after 100 hours. Steel sheets without cracks after 100 hours were determined to have good delayed fracture resistance. In the table, the delayed fracture resistance of the steel sheets without cracks after 100 hours are indicated as "Excellent", while the delayed fracture resistance of other steel sheets are indicated as "Poor".

TABLE 1

| Steel | Chemical composition (mass %) | | | | | | | | | | | ([% N]/14)/ |
|---|---|---|---|---|---|---|---|---|---|---|---|---|
| sample ID | C | Si | Mn | P | S | Al | N | Ti | Nb | B | Other | ([% Ti]/47.9) |
| A | 0.15 | 1.10 | 3.2 | 0.011 | 0.0010 | 0.040 | 0.0041 | 0.018 | 0.011 | 0.0012 | | 0.78 |
| B | 0.09 | 0.95 | 2.9 | 0.015 | 0.0018 | 0.036 | 0.0035 | 0.021 | 0.015 | 0.0018 | | 0.57 |
| C | 0.34 | 1.03 | 3.3 | 0.021 | 0.0020 | 0.042 | 0.0052 | 0.020 | 0.022 | 0.0018 | | 0.89 |
| D | 0.19 | 0.65 | 3.5 | 0.018 | 0.0012 | 0.038 | 0.0038 | 0.018 | 0.001 | 0.0016 | | 0.72 |
| E | 0.22 | 0.66 | 3.4 | 0.022 | 0.0016 | 0.040 | 0.0036 | 0.022 | 0.082 | 0.0017 | | 0.56 |
| F | 0.24 | 0.82 | 3.0 | 0.016 | 0.0009 | 0.042 | 0.0044 | 0.021 | 0.035 | 0.0001 | | 0.72 |
| G | 0.20 | 1.10 | 2.9 | 0.012 | 0.0014 | 0.039 | 0.0033 | 0.017 | 0.042 | 0.0084 | | 0.66 |
| H | 0.19 | 0.78 | 3.4 | 0.016 | 0.0010 | 0.036 | 0.0058 | 0.015 | 0.027 | 0.0022 | | 1.32 |
| I | 0.16 | 0.85 | 3.2 | 0.011 | 0.0012 | 0.037 | 0.0042 | 0.022 | 0.031 | 0.0020 | Cr 0.21, Mo 0.272 | 0.65 |
| J | 0.12 | 1.01 | 3.7 | 0.012 | 0.0009 | 0.039 | 0.0033 | 0.024 | 0.005 | 0.0021 | V 0.080 | 0.47 |
| K | 0.22 | 0.81 | 2.8 | 0.018 | 0.0021 | 0.045 | 0.0061 | 0.032 | 0.018 | 0.0016 | Cu 0.11, Ca 0.0005 | 0.65 |
| L | 0.27 | 0.96 | 2.7 | 0.010 | 0.0008 | 0.029 | 0.0032 | 0.015 | 0.032 | 0.0020 | Ni 0.12, Ta 0.007 | 0.73 |
| M | 0.18 | 0.99 | 2.9 | 0.008 | 0.0015 | 0.039 | 0.0028 | 0.020 | 0.023 | 0.0015 | Sb 0.009, Mg 0.0010 | 0.48 |
| N | 0.18 | 0.76 | 3.1 | 0.011 | 0.0009 | 0.039 | 0.0040 | 0.021 | 0.011 | 0.0022 | Sn 0.008, Co 0.008 | 0.65 |
| O | 0.25 | 0.92 | 2.9 | 0.012 | 0.0014 | 0.044 | 0.0033 | 0.018 | 0.041 | 0.0021 | REM 0.0022 | 0.63 |
| P | 0.17 | 0.91 | 3.1 | 0.013 | 0.0011 | 0.038 | 0.0028 | 0.021 | 0.021 | 0.0017 | W 0.122, Zr 0.0018 | 0.46 |
| Q | 0.18 | 0.99 | 3.2 | 0.012 | 0.0013 | 0.035 | 0.0036 | 0.020 | 0.024 | 0.0022 | | 0.62 |
| R | 0.19 | 0.85 | 2.9 | 0.011 | 0.0012 | 0.040 | 0.0038 | 0.018 | 0.016 | 0.0019 | Te 0.005, Hf 0.02, Bi 0.002 | 0.72 |
| S | 0.20 | 1.28 | 3.3 | 0.013 | 0.0010 | 0.036 | 0.0045 | 0.019 | 0.022 | 0.0023 | | 0.81 |

Underlines indicate outside the appropriate range of this disclosure.

TABLE 2

| No. | Steel sample ID | First heating temperature (° C.) | Holding time (s) | Second heating temperature (° C.) | Average heating rate from first heating temperature to second heating temperature (° C./s) | Average cooling rate from second heating temperature to 500° C. or lower (° C./s) | Coating or plating | Reheating temperature (° C.) | Holding time (s) | Remarks |
|---|---|---|---|---|---|---|---|---|---|---|
| 1 | A | 870 | 40 | 1110 | 80 | 80 | Without | 160 | 900 | Example |
| 2 | A | 860 | 30 | 1100 | 60 | 60 | GI | 90 | 10800 | Example |
| 3 | A | 900 | 30 | 1140 | 80 | 80 | GA | 180 | 1800 | Example |
| 4 | A | 830 | 50 | 1150 | 80 | 80 | GI | 150 | 3600 | Comparative Example |
| 5 | A | 880 | 5 | 1120 | 80 | 80 | Without | 120 | 7200 | Comparative Example |
| 6 | A | 900 | 20 | 980 | 80 | 80 | Without | 100 | 10800 | Comparative Example |
| 7 | A | 890 | 40 | 1210 | 80 | 80 | GA | 120 | 2400 | Comparative Example |

TABLE 2-continued

| No. | Steel sample ID | First heating temperature (° C.) | Holding time (s) | Second heating temperature (° C.) | Average heating rate from first heating temperature to second heating temperature (° C./s) | Average cooling rate from second heating temperature to 500° C. or lower (° C./s) | Coating or plating | Reheating temperature (° C.) | Holding time (s) | Remarks |
|---|---|---|---|---|---|---|---|---|---|---|
| 8 | A | 860 | 40 | 1100 | 40 | 80 | Without | 90 | 7200 | Comparative Example |
| 9 | A | 870 | 30 | 1190 | 80 | 40 | Without | 100 | 7200 | Comparative Example |
| 10 | B | 860 | 30 | 1100 | 80 | 80 | GA | 120 | 3600 | Comparative Example |
| 11 | C | 880 | 40 | 1120 | 80 | 80 | GI | 160 | 2400 | Comparative Example |
| 12 | D | 900 | 40 | 1060 | 80 | 80 | GA | 180 | 2400 | Comparative Example |
| 13 | E | 910 | 50 | 1070 | 80 | 80 | GA | 100 | 10800 | Comparative Example |
| 14 | F | 900 | 30 | 1140 | 80 | 80 | GA | 120 | 3600 | Comparative Example |
| 15 | G | 890 | 40 | 1130 | 80 | 80 | GA | 180 | 800 | Comparative Example |
| 16 | H | 890 | 40 | 1050 | 80 | 80 | GA | 180 | 900 | Comparative Example |
| 17 | I | 860 | 50 | 1180 | 80 | 80 | GA | 100 | 7200 | Example |
| 18 | J | 910 | 50 | 1150 | 80 | 80 | GI | 180 | 800 | Example |
| 19 | K | 890 | 30 | 1130 | 80 | 80 | GI | 120 | 7200 | Example |
| 20 | L | 870 | 50 | 1030 | 80 | 80 | Without | 140 | 3600 | Example |
| 21 | M | 890 | 40 | 1130 | 80 | 80 | GA | 80 | 18000 | Example |
| 22 | N | 900 | 50 | 1140 | 80 | 80 | GA | 190 | 1200 | Example |
| 23 | O | 880 | 30 | 1040 | 80 | 80 | GA | 160 | 1500 | Example |
| 24 | P | 870 | 40 | 1110 | 80 | 80 | GA | 170 | 1000 | Example |
| 25 | Q | 900 | 40 | 1060 | 80 | 80 | GA | 150 | 1500 | Example |
| 26 | Q | 880 | 50 | 1120 | 80 | 80 | GA | 60 | 18000 | Comparative Example |
| 27 | Q | 910 | 40 | 1150 | 80 | 80 | GA | 160 | 500 | Comparative Example |
| 28 | Q | 900 | 40 | 1110 | 80 | 80 | GA | 220 | 1800 | Comparative Example |
| 29 | Q | 880 | 30 | 1040 | 80 | 80 | GA | None | None | Comparative Example |
| 30 | Q | 880 | 40 | 1140 | 80 | 80 | Without | 180 | 1500 | Example |
| 31 | S | 900 | 40 | 1090 | 80 | 80 | GA | 190 | 900 | Comparative Example |

Underlines indicate outside the appropriate range of this disclosure.

TABLE 3

| No. | Steel sample ID | Total area ratio of martensite and bainite (%) | Residual microstructure | Prior austenite grain size (μm) | B concentration at prior austenite grain boundary (mass %) | C concentration at prior austenite grain boundary (mass %)/C content in steel (mass %) | Amount of precipitated Fe (mass ppm) |
|---|---|---|---|---|---|---|---|
| 1 | A | 99 | Residual γ | 6 | 0.25 | 2.5 | 80 |
| 2 | A | 99 | Residual γ | 5 | 0.31 | 3.1 | 122 |
| 3 | A | 99 | Residual γ | 6 | 0.22 | 2.6 | 115 |
| 4 | A | 88 | Ferrite | 6 | 0.25 | 2.0 | 184 |
| 5 | A | 99 | Residual γ | 12 | 0.43 | 3.2 | 152 |
| 6 | A | 99 | Residual γ | 8 | 0.07 | 2.5 | 127 |
| 7 | A | 99 | Residual γ | 14 | 0.44 | 2.8 | 133 |
| 8 | A | 99 | Residual γ | 15 | 0.38 | 2.8 | 146 |
| 9 | A | 99 | Residual γ | 12 | 0.42 | 2.9 | 118 |
| 10 | B | 87 | Ferrite | 7 | 0.32 | 1.8 | 82 |
| 11 | C | 99 | Residual γ | 8 | 0.06 | 3.4 | 129 |
| 12 | D | 99 | Residual γ | 18 | 0.37 | 3.2 | 136 |
| 13 | E | 99 | Residual γ | 5 | 0.28 | 2.7 | 115 |
| 14 | F | 99 | Residual γ | 6 | 0.00 | 3.2 | 172 |
| 15 | G | 99 | Residual γ | 7 | 0.52 | 2.9 | 134 |
| 16 | H | 99 | Residual γ | 12 | 0.04 | 2.3 | 118 |
| 17 | I | 99 | Residual γ | 6 | 0.26 | 2.5 | 97 |
| 18 | J | 99 | Residual γ | 7 | 0.33 | 3.3 | 126 |
| 19 | K | 99 | Residual γ | 6 | 0.29 | 3.1 | 145 |
| 20 | L | 99 | Residual γ | 7 | 0.29 | 2.7 | 139 |
| 21 | M | 99 | Residual γ | 6 | 0.27 | 2.6 | 120 |
| 22 | N | 99 | Residual γ | 7 | 0.31 | 3.3 | 148 |
| 23 | O | 99 | Residual γ | 6 | 0.40 | 2.8 | 167 |
| 24 | P | 99 | Residual γ | 7 | 0.35 | 2.6 | 104 |
| 25 | Q | 99 | Residual γ | 8 | 0.34 | 2.9 | 124 |
| 26 | Q | 99 | Residual γ | 7 | 0.33 | 1.3 | 98 |
| 27 | Q | 99 | Residual γ | 7 | 0.29 | 1.2 | 92 |
| 28 | Q | 99 | Residual γ | 7 | 0.31 | 2.2 | 322 |
| 29 | Q | 99 | Residual γ | 7 | 0.42 | 1.2 | 66 |
| 30 | R | 99 | Residual γ | 6 | 0.46 | 3.2 | 122 |
| 31 | S | 99 | Residual γ | 6 | 0.37 | 3.4 | 58 |

TABLE 3-continued

| No. | $a_{dislocation}/a_{grain\ boundary}$ | TS (MPa) | Toughness | Brittle-ductile transition temperature (° C.) | Delayed fracture resistance | Crack initiation time in delayed fracture test (hr) | Remarks |
|---|---|---|---|---|---|---|---|
| 1 | 1.6 | 1292 | Excellent | −80 | Excellent | >100 | Example |
| 2 | 1.7 | 1311 | Excellent | −60 | Excellent | >100 | Example |
| 3 | 1.7 | 1284 | Excellent | −60 | Excellent | >100 | Example |
| 4 | 1.8 | 1051 | Excellent | −80 | Excellent | >100 | Comparative Example |
| 5 | 1.4 | 1231 | Poor | −20 | Poor | 68 | Comparative Example |
| 6 | 1.5 | 1295 | Poor | −10 | Poor | 48 | Comparative Example |
| 7 | 1.5 | 1227 | Poor | −20 | Poor | 80 | Comparative Example |
| 8 | 1.5 | 1208 | Poor | −20 | Poor | 74 | Comparative Example |
| 9 | 1.6 | 1230 | Poor | −30 | Poor | 84 | Comparative Example |
| 10 | 1.4 | 1021 | Excellent | −60 | Excellent | >100 | Comparative Example |
| 11 | 1.7 | 1574 | Poor | 0 | Poor | 36 | Comparative Example |
| 12 | 1.5 | 1322 | Poor | −20 | Poor | 60 | Comparative Example |
| 13 | 1.6 | 1507 | Poor | 0 | Excellent | >100 | Comparative Example |
| 14 | 1.6 | 1538 | Poor | 0 | Poor | 42 | Comparative Example |
| 15 | 1.5 | 1494 | Poor | 0 | Excellent | >100 | Comparative Example |
| 16 | 1.6 | 1458 | Poor | −10 | Poor | 82 | Comparative Example |
| 17 | 1.7 | 1232 | Excellent | −60 | Excellent | >100 | Example |
| 18 | 1.6 | 1196 | Excellent | −80 | Excellent | >100 | Example |
| 19 | 1.5 | 1522 | Excellent | −50 | Excellent | >100 | Example |
| 20 | 1.5 | 1530 | Excellent | −50 | Excellent | >100 | Example |
| 21 | 1.6 | 1364 | Excellent | −60 | Excellent | >100 | Example |
| 22 | 1.7 | 1226 | Excellent | −80 | Excellent | >100 | Example |
| 23 | 1.6 | 1498 | Excellent | −60 | Excellent | >100 | Example |
| 24 | 1.7 | 1196 | Excellent | −80 | Excellent | >100 | Example |
| 25 | 1.7 | 1344 | Excellent | −50 | Excellent | >100 | Example |
| 26 | 1.1 | 1385 | Poor | −10 | Poor | 44 | Comparative Example |
| 27 | 1.1 | 1402 | Poor | 0 | Poor | 58 | Comparative Example |
| 28 | 1.8 | 1303 | Excellent | 50 | Poor | 56 | Comparative Example |
| 29 | 1.1 | 1439 | Poor | −10 | Poor | 62 | Comparative Example |
| 30 | 1.6 | 1277 | Excellent | −60 | Excellent | >100 | Example |
| 31 | 1.1 | 1358 | Excellent | −60 | Poor | 60 | Comparative Example |

Underlines indicate outside the appropriate range of this disclosure.

Table 3 presents that the examples each have a TS of 1180 MPa or higher and excellent delayed fracture resistance and toughness. On the other hand, one or more of the TS, delayed fracture resistance, and toughness are poor in the comparative examples.

The invention claimed is:

1. A high strength steel sheet comprising a chemical composition containing, in mass %:

C: 0.10% or more and 0.30% or less;

Si: 0.20% or more and 1.20% or less;

Mn: 2.5% or more and 4.0% or less;

P: 0.050% or less;

S: 0.020% or less;

Al: 0.10% or less;

N: 0.01% or less;

Ti: 0.100% or less;

Nb: 0.002% or more and 0.050% or less; and

B: 0.0005% or more and 0.0050% or less, with the balance being Fe and inevitable impurities, and satisfying the following formula (1), wherein the total area ratio of martensite and bainite is 95% or more, the grain size of prior austenite grains is 10 μm or less, the B concentration at a prior austenite grain boundary is 0.10% or more in mass %, the C concentration at the prior austenite grain boundary is 1.5 times or more than the C content in the steel, the amount of precipitated Fe is 200 mass ppm or less, and for a defined in the following formula (2), a ratio of $a_{dislocation}$ on dislocation to $a_{grain\ boundary}$ on the prior austenite grain boundary: $a_{dislocation}/a_{grain\ boundary}$ is 1.3 or more:

$$([\%\ N]/14)/([\%\ Ti]/47.9) < 1.0;\ \text{and} \quad (1)$$

$$a = C_2^+/(C^{2+} + C^+), \quad (2)$$

in the formula (1), [% N] and [% Ti] indicate the N content and the Ti content in the steel in mass %, respectively, and in the formula (2):

$C_2^+$ indicates an ion intensity with a mass-to-charge ratio of 24 Da analyzed with a 3D atom probe;

$C^{2+}$ indicates an ion intensity with a mass-to-charge ratio of 6 Da analyzed with the 3D atom probe; and $C^+$ indicates an ion intensity with a mass-to-charge ratio of 12 Da analyzed with the 3D atom probe.

2. The high strength steel sheet according to claim 1, wherein the chemical composition further contains at least one element selected from, in mass %:

V: 0.100% or less;

Mo: 0.500% or less;

Cr: 1.00% or less;

Cu: 1.00% or less;

Ni: 0.50% or less;

Sb: 0.200% or less;

Sn: 0.200% or less;

Ta: 0.200% or less;

W: 0.400% or less;

Zr: 0.0200% or less;

Ca: 0.0200% or less;

Mg: 0.0200% or less;

Co: 0.020% or less;

REM: 0.0200% or less;

Te: 0.020% or less;

Hf: 0.10% or less; or

Bi: 0.200% or less.

3. A high strength coated or plated steel sheet having a coated or plated layer on at least one surface of the high strength steel sheet according to claim 1.

4. A member formed using the high strength steel sheet according to claim 1 for at least a portion thereof.

5. A high strength coated or plated steel sheet having a coated or plated layer on at least one surface of the high strength steel sheet according to claim 2.

6. A member formed using the high strength steel sheet according to claim 2 for at least a portion thereof.

7. A member formed using the high strength coated or plated steel sheet according to claim 3 for at least a portion thereof.

8. A member formed using the high strength coated or plated steel sheet according to claim 5 for at least a portion thereof.

9. A method of producing a high strength steel sheet, comprising:

hot rolling a steel slab having the chemical composition according to claim 1 to form a hot-rolled sheet;

cold rolling the hot-rolled sheet to form a cold-rolled sheet;

performing an annealing process in which the cold-rolled sheet is heated to a first heating temperature of 850° C. or higher and 920° C. or lower and held for 10 seconds or longer, the temperature is then raised to a second heating temperature of 1000° C. or higher and 1200° C. or lower at an average heating rate of 50° C./s or more, and the sheet is cooled to 500° C. or lower at an average cooling rate of 50° C./s or more within 5 seconds after reaching the second heating temperature, and after the annealing process, performing a reheating process in which the cold-rolled sheet is held at a reheating temperature of 70° C. or higher and 200° C. or lower for 600 seconds or longer to obtain a high strength steel sheet.

10. A method of producing a high strength coated or plated steel sheet, comprising a coating or plating process in which, after the annealing process according to claim 9 and before the reheating process, the high strength steel sheet is subjected to coating or plating treatment to obtain a high strength coated or plated steel sheet.

11. A method of producing a high strength steel sheet, comprising:

hot rolling a steel slab having the chemical composition according to claim 2 to form a hot-rolled sheet;

cold rolling the hot-rolled sheet to form a cold-rolled sheet;

performing an annealing process in which the cold-rolled sheet is heated to a first heating temperature of 850° C. or higher and 920° C. or lower and held for 10 seconds or longer, the temperature is then raised to a second heating temperature of 1000° C. or higher and 1200° C. or lower at an average heating rate of 50° C./s or more, and the sheet is cooled to 500° C. or lower at an average cooling rate of 50° C./s or more within 5 seconds after reaching the second heating temperature, and after the annealing process, performing a reheating process in which the cold-rolled sheet is held at a reheating temperature of 70° C. or higher and 200° C. or lower for 600 seconds or longer to obtain a high strength steel sheet.

12. A method of producing a high strength coated or plated steel sheet, comprising a coating or plating process in which, after the annealing process according to claim 11 and before the reheating process, the high strength steel sheet is subjected to coating or plating treatment to obtain a high strength coated or plated steel sheet.

* * * * *